US005620278A

United States Patent [19]

Clarke

[11] Patent Number: 5,620,278

[45] Date of Patent: Apr. 15, 1997

[54] TILE

[75] Inventor: Cameron J. Clarke, Delgany, Ireland

[73] Assignee: Shapes & Solutions Limited, Delgany, Ireland

[21] Appl. No.: 341,539

[22] PCT Filed: May 17, 1993

[86] PCT No.: PCT/IE93/00027

§ 371 Date: Mar. 31, 1995

§ 102(e) Date: Mar. 31, 1995

[87] PCT Pub. No.: WO93/23625

PCT Pub. Date: Nov. 25, 1993

[30] Foreign Application Priority Data

May 18, 1992 [IE] Ireland ..... 1583/92

[51] Int. Cl.[6] ..... E01C 5/00

[52] U.S. Cl. ..... 404/34; 404/41; 52/311.2; 52/314

[58] Field of Search ..... 52/311.2, 314, 52/316, 388, 519, 554; 404/34, 41, 42

[56] References Cited

U.S. PATENT DOCUMENTS

| | | | |
|---|---|---|---|
| 613,333 | 11/1898 | Thomas | 52/311.2 |
| 1,474,779 | 11/1923 | Kammer | 52/311.2 |
| 4,544,305 | 10/1985 | Hair | 52/311.2 X |
| 4,620,998 | 11/1986 | Lalvani | 52/311.2 X |
| 4,973,192 | 11/1990 | Hair | 404/42 X |
| 5,163,777 | 11/1992 | Krueger et al. | 404/41 |
| 5,238,721 | 8/1993 | Nakazawa | 52/388 X |

FOREIGN PATENT DOCUMENTS

| | | | |
|---|---|---|---|
| 515227 | 11/1952 | Belgium | 404/41 |
| 0218537 | 4/1987 | European Pat. Off. . | |
| 2585386 | 1/1987 | France . | |
| 3409114 | 9/1985 | Germany . | |
| 1225046 | 3/1971 | United Kingdom . | |

*Primary Examiner*—Lanna Mai

*Attorney, Agent, or Firm*—Jacobson, Price, Holman & Stern, PLLC

[57] ABSTRACT

A four sided tile, particularly for paving, flooring or cladding includes a first side edge, a second slide edge parallel with shorter than the first side edge, and third and fourth side edges which are not parallel. The length of the shorter side edges is the same and the sum of their length is equal to the length of the larger side. The side edges are preferable curved with radii of equal length.

20 Claims, 5 Drawing Sheets

TILE

The invention relates to tiles.

In this specification the term "tiles" refers to non-fired or fired clay or cementitious bricks, blocks, slabs or tiles, ceramic or other glazed tiles, parquet tiles, wooden tiles, vinyl tiles, linoleum tiles, cork tiles, quarry tiles and any similar constructional elements whether for interior or exterior use as wall tiles, ceiling tiles, floor tiles, tiles for roadways, footways, entrance drives, or the like, paving tiles, cladding, building generally or similar use.

Several different types of tiles are available however, they are often limited as regards resistance to breakage and/or interlocking and especially as regards the scope for laying a range of different aesthetically pleasing patterns.

The object of the invention is to provide an improved tile which will overcome at least some of these problems.

According to the invention there is provided a tile etc. as per new claim 1. Preferably the second side edge is opposite and generally parallel to the first side edge.

In one particularly preferred embodiment of the invention the side edges are of curvilinear shape, the curvilinear shape of the second, third and forth side edges being substantially the same and conforming with the curvilinear shape of part of the first side edge.

Most preferably the curvilinear shape is generally arcuate and the radius of the arc of the second, third and fourth side edges is substantially equal and also equal to the radius of the first side edge. Preferably the second, third and fourth side edges are of generally concave shape and the first side edge is of generally convex shape.

In a particularly preferred embodiment of the invention all the side edges are curved, each side edge being a portion of a circle, and the radii of curvature of all of the side edges are equal.

In one embodiment of the invention the first and third and first and fourth side edges respectively subtend of an angle of approximately 60°.

In one embodiment of the invention the tile has embossed or imprinted thereon a pattern. The pattern may for example comprise curvilinear shapes extending from the midpoint of the second side edge, to points of substantially ⅓ and ⅔ the length of the first side edge. Preferably the radius of the curvilinear pattern is the same as the radius of the second, third and fourth side edges.

In another embodiment of the invention the first side edge comprises a number of portions which extend at angles to one another. Preferably the angle subtended between adjacent first side edge portions is 120°.

In a preferred embodiment arrangement there are three first side edge portions of equal length and each having the same length as the length of the second, third and fourth side edges.

In a further embodiment of the invention the tile comprises a number of sub tiles joined together. The sub tiles may be joined by means of a mesh. Preferably frangible links are provided between at least some of the sub tiles.

The invention also provides a composite tile comprising tile according to the invention with another similar tile or tiles or part(s) thereof.

The invention further provides filler and/or starter tile pieces for fitting between a tile or tiles according to the invention and a boundary, a filler and/or starter tile piece at least partly conforming to portion of a tile according to the invention.

According to another aspect, the invention provides a tiling assembly comprising a plurality of tiles according to the invention.

According to a further aspect, the invention provides a tiling system such as a pavement, floor, wall, wall cladding or the like formed from a plurality of tiles according to the invention.

The invention also provides a laid tiling system such as a pavement, floor, wall, wall cladding or the like formed from a plurality of tiles according to the invention laid in side-by-side relation.

The invention will be more clearly understood from the following description thereof given by way of example only with reference to the accompanying drawings in which.

Figure 1:
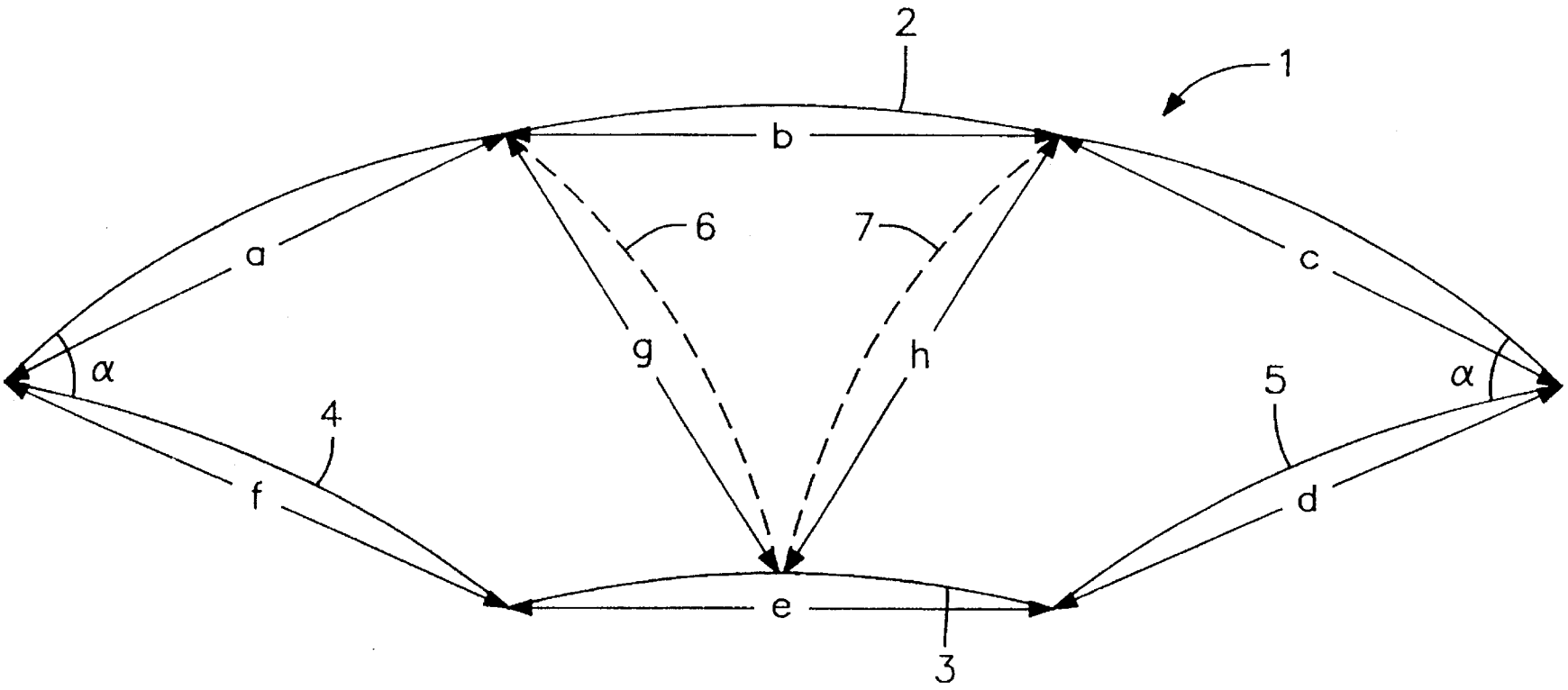
FIG. 1 is a plan view of a tile according to the invention.

Referring to the drawings and initially to FIG. 1 thereof there is illustrated a tile according to the invention indicated generally by the reference numeral 1. The tile 1 has a first side edge 2, a second side edge 3 which in this case is shorter, opposite and generally parallel to the first side edge 2. The tile also has third and fourth side edges 4, 5 which extend between the first and second side edges 2, 3. It will be noted that the third and fourth side edges 4, 5 are not parallel.

In this preferred embodiment the side edges are all of curvilinear shape, the curvilinear shape of the second, third and fourth side edges 3, 4, 5 being substantially the same and conforming with the curvilinear shape of part of the first side edge 2. In this case the curvilinear shape is part of the circumference of a circle which has a radius, the radius of the curvilinear shape of the side edges 2, 3, 4, 5, all being substantially the same length.

The first and third and first and fourth side edges 2, 4 and 2, 5 respectively subtend and angle $\alpha$ which is approximately 60°.

Each of the lengths a, b, c, d, e and f, illustrated in FIG. 1 are substantially equal.

If desired, a pattern may be embossed or imprinted on the surface of the tile. In the case illustrated in FIG. 1 the pattern comprises arcuate pattern shapes 6, 7 which extend from the midpoint of the side edge 3 to respectively points ⅓ and ⅔ along the first side edge 2. The radius of the pattern line 6, 7 is the same and is again equal to the radius of each of the side edges. The lengths g, h are the same and are equal to a, b, c, d, e and f.

The pattern lines 6, 7 may also define scoring lines along which the tile may be cut to form filler tile pieces for use in laid tiling systems.

The tile 1 according to the invention may be used to form a very large range of aesthetically pleasing different patterns.

The tiles used to form a particular pattern may all be of the same pattern, ornament or colour or may be of two or more patterns, ornaments or colours.

Figure 2:
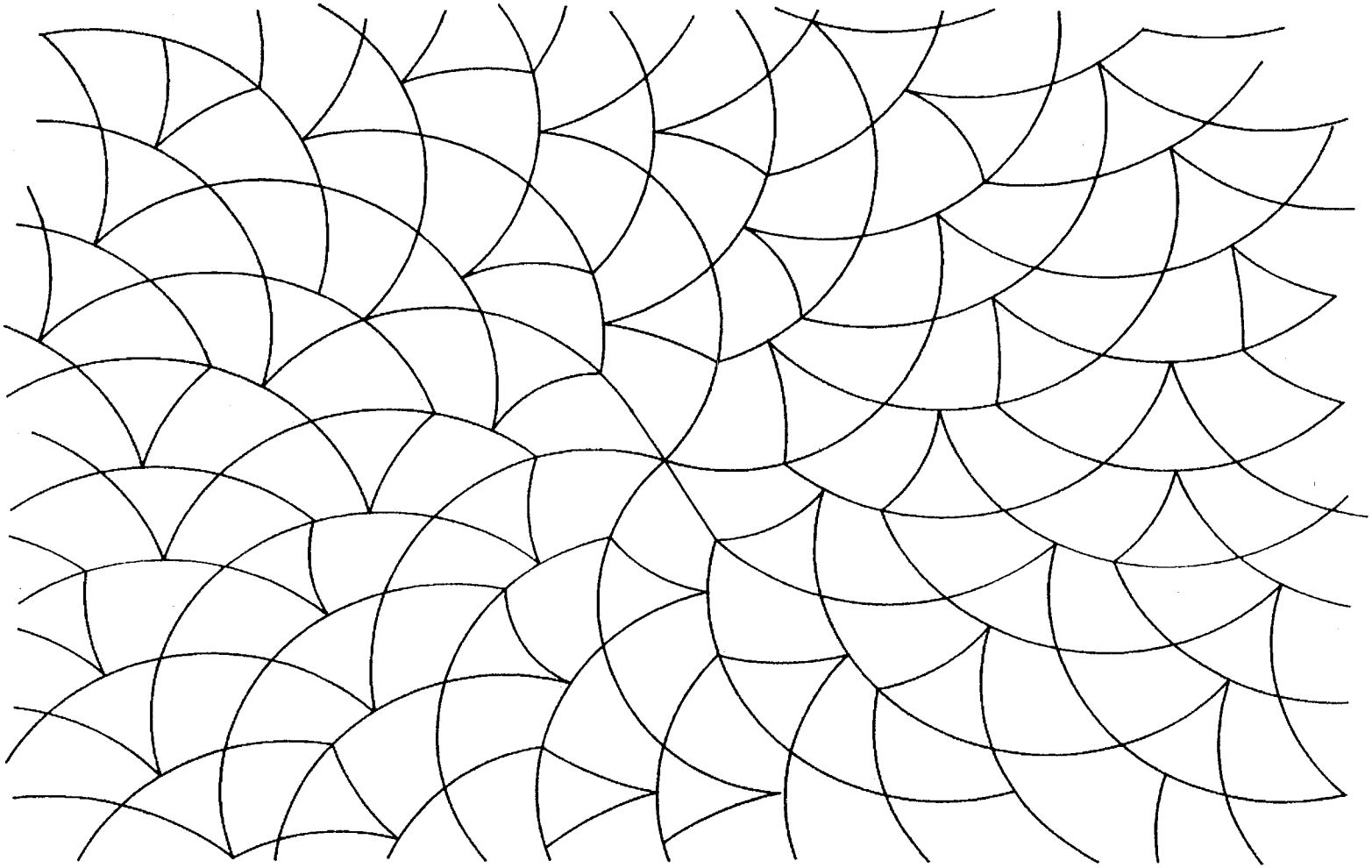
FIGS. 2 to 4 are plan views illustrating the pattern of paving, cladding or like formed using a plurality of the tiles of FIG. 1.
Figure 3:
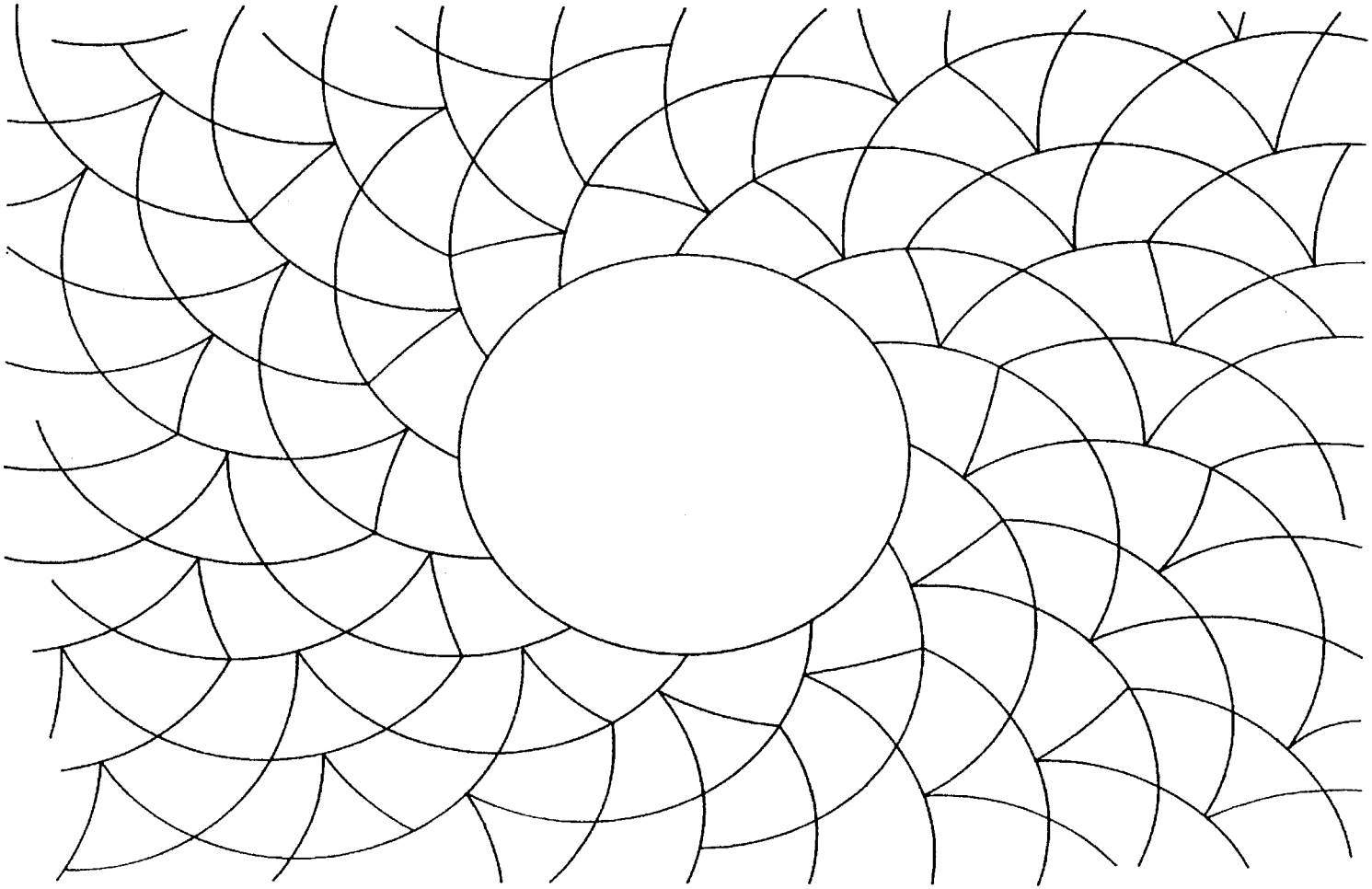
Figure 4:
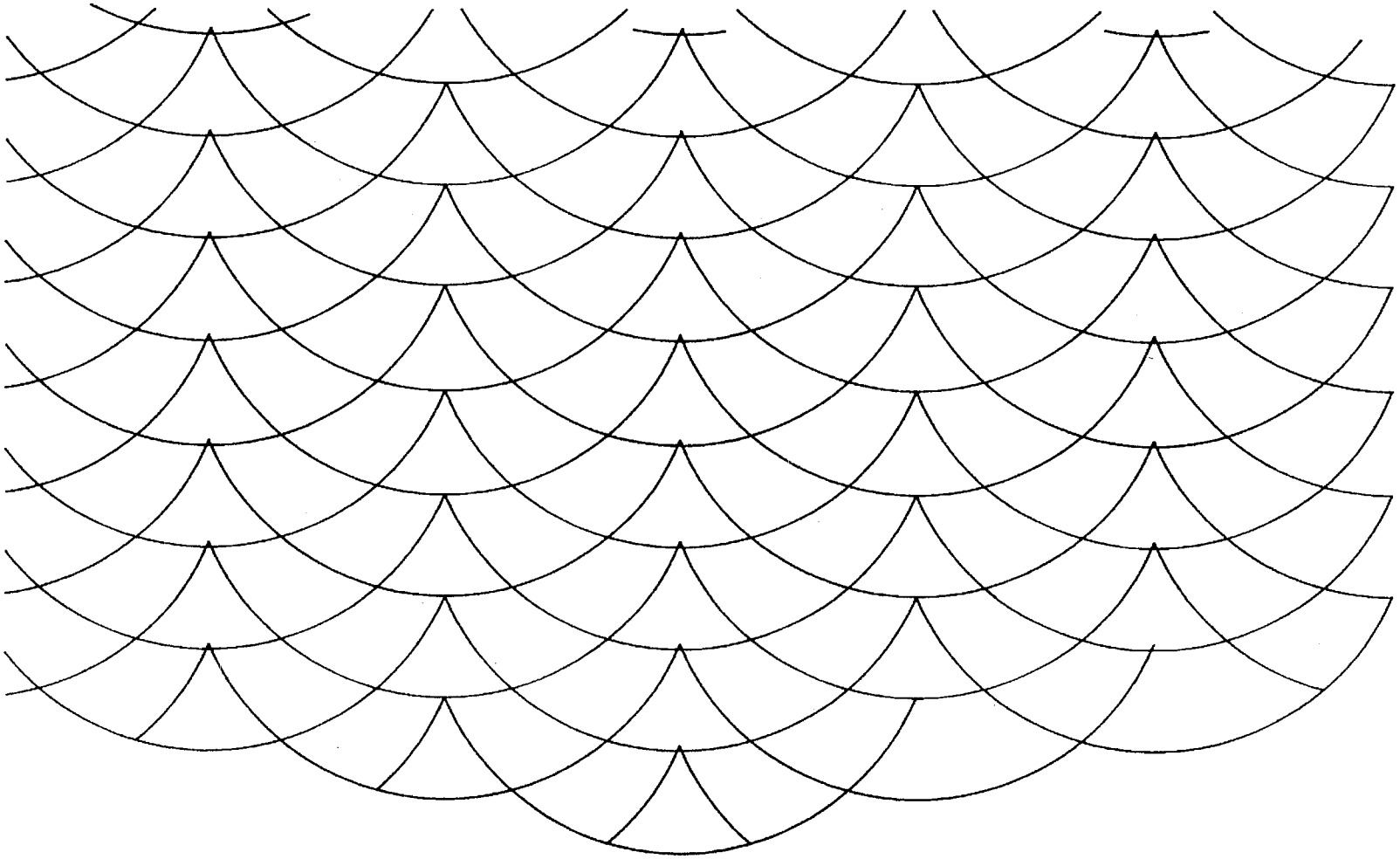

The arrangements illustrated in FIGS. 2 to 4 are only illustrative examples of the patterns which could be formed using the tiles according to the invention. It will be noted that in some of these patterns a filler tile part, as described above, is used in some configurations.

Figure 5:
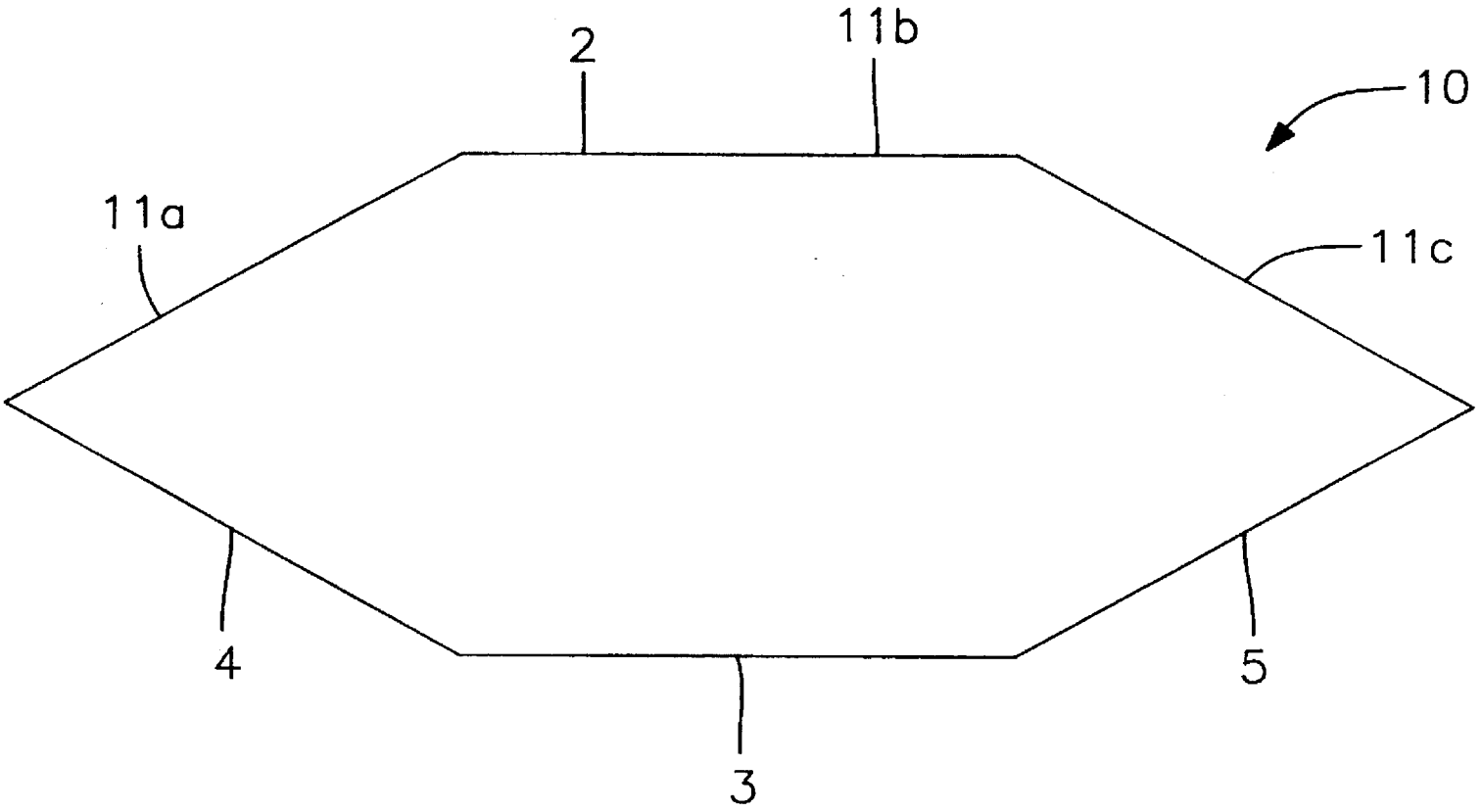
FIG. 5 is a plan view of another tile according to the invention.

Referring to FIG. 5 there is illustrated another tile 10 according to the invention which is similar to the tile described above with reference to FIG. 1 and like parts are assigned the same reference numerals. In this case, the first side edge 2 is divided into three portions 11*a*, 11*b*, 11*c* of equal length. The length of each of the portions 11*a*, 11*b*, 11*c* is equal to the length of each of the second, third and fourth side edges 3, 4, 5. The angle subtended between adjacent first side edge portions is 120°. All of the aspects described above with reference to the tile of FIG. 1 may also be applied to this tile.

It will be appreciated that two or more of the tiles according to the invention may be combined to form any desired shape which may be useful in covering large areas for repeating patterns. Where such a composite tile is provided it may be provided with a scoring line or lines along which the composite tile may be broken to form the basic tile shape illustrated.

It will also be appreciated that the tiles according to the invention may be formed with projections and/or recesses for interlocking engagement, one with another or with a separate interlocking piece to join adjacent tiles.

It will be appreciated also that the tile may be of any suitable shape in transverse cross-section. For example the side edges of the tile may diverge inwardly from the upper face thereof for bedding into a bed of sand or the like.

It will be appreciated that the tile may comprise a number of sub tiles of any shape and configuration which when joined together form the required shape. The jointing may for example be by means of a mesh and frangible links could be provided between some or all of the sub tiles. There may be a very large number of sub tiles or a relatively small number. For example, in the case of the tile of FIG. 1, the sub tiles may be as defined by the pattern lines 6, 7 which in this case may define joint lines between adjacent sub tiles. The tile of FIG. 4 could also be divided into sub tiles in a similar manner.

Many other variations and modifications on the invention will be readily apparent and accordingly the invention is not limited to the embodiments hereinbefore described which may be varied in both construction and detail.

I claim:

1. A tile comprising:

a first side edge, a second side edge, third and fourth side edges which extend between the first and second side edges, the second, third and fourth side edges being of substantially equal length, the length of the first side edge being substantially the sum of the lengths of the other three side edges, all of the side edges being of curvilinear shape, and each side edge defining a portion of a circle, the radii of curvature of all of the side edges being substantially equal.

2. A tile as claimed in claim 1 wherein the second side edge is opposite and generally parallel to at least portion of the first side edge.

3. A tile as claimed in claim 1 wherein the side edges are of curvilinear shape, the curvilinear shape of the second, third and forth side edges being substantially the same and conforming with the curvilinear shape of part of the first side edge.

4. A tile as claimed in claim 3 wherein the curvilinear shape is generally arcuate and the radius of the arc of the second, third and forth side edges is substantially equal and also equal to the radius of the first side edge.

5. A tile as claimed in claim 3 wherein the second, third and forth side edges are of generally concave shape and the first side edge is of generally convex shape.

6. A tile as claimed in claim 3 wherein all of the side edges are curved, each side edge being a portion of a circle, and the radii of curvature of all of the side edges are equal.

7. A tile as claimed in claim 1 wherein the first and third and first and forth side edges respectively subtend of an angle of approximately 60°.

8. A tile as claimed in claim 1 wherein the tile has embossed or imprinted thereon a pattern.

9. A tile as claimed in claim 8 wherein the pattern comprises curvilinear shapes extending from the midpoint of the second side edge, to points of substantially ⅓ and ⅔ the length of the first side edge.

10. A tile as claimed in claim 9 wherein the radius of the curvilinear pattern is the same as the radius of the second, third and forth side edges.

11. A tile as claimed in claim 1, wherein the first side edge comprises a number of portions which extend at angles to one another.

12. A tile as claimed in claim 11 wherein the angle subtended between adjacent first side edge portions is 120°.

13. A tile as claimed in claim 11 wherein there are three first side edge portions of equal length and each having the same length as the length of the second, third and fourth side edges.

14. A composite tile comprising a tile as claimed in claim 1 with another similar tile or tiles or part(s) thereof.

15. A filler and/or tile piece for fitting between a tile or tiles as claimed in claim 1 and a boundary, the filler and/or tile piece at least partly conforming to portion of a tile as claimed in any preceding claim.

16. A tiling assembly comprising a plurality of tiles as claimed in claim 1.

17. A tiling system such as a pavement, floor, wall, wall cladding or the like formed from a plurality of tiles as claimed in claim 1.

18. A laid tiling system such as a pavement, floor, wall, wall cladding or the like formed from a plurality of tiles as claimed in claim 1 laid in side-by-side relation.

19. A tile comprising a first side edge, a second side edge, third and fourth side edges which extend between the first and second side edges, the second, third and fourth side edges being of substantially equal length, the length of the first side edge being substantially the sum of the lengths of the other three side edges, a pattern embossed or imprinted on the tile, the pattern including curvilinear shapes extending from a midpoint of the second side edge, to points of substantially one-third and two-thirds the length of the first side edge.

20. A tile as claimed in claim 19, wherein the radius of the curvilinear pattern is the same as the radius of the second, third and fourth side edges.

* * * * *